US006250945B1

(12) United States Patent
Murakami et al.

(10) Patent No.: US 6,250,945 B1
(45) Date of Patent: Jun. 26, 2001

(54) HALF-FITTING PREVENTION CONNECTOR

(75) Inventors: Takao Murakami; Masaru Fukuda, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/592,912

(22) Filed: Jun. 13, 2000

(30) Foreign Application Priority Data

Jun. 16, 1999 (JP) ..... 11-169932

(51) Int. Cl.[7] ..... H01R 13/627
(52) U.S. Cl. ..... 439/353; 439/700
(58) Field of Search ..... 439/352, 188, 439/353, 351, 488, 489, 142, 700, 122

(56) References Cited

U.S. PATENT DOCUMENTS 5,114,359 * 5/1992 Chrstima et al. ..... 439/271
5,746,619 * 5/1998 Harting et al. ..... 439/352
5,827,086 * 10/1998 Fukuda ..... 439/357

FOREIGN PATENT DOCUMENTS 5-53157 7/1993 (JP) ..... H01R/13/639
5-81967 11/1993 (JP) ..... H01R/13/639
9-55261 2/1997 (JP) ..... H01R/13/64

* cited by examiner

*Primary Examiner*—Neil Abrams
*Assistant Examiner*—J. F. Duverne
(74) *Attorney, Agent, or Firm*—Sughrue, Mion, Zinn, Macpeak & Seas, PLLC

(57) ABSTRACT

A half-fitting prevention connector (200) includes a lock arm (53) which is formed on an outer surface of a housing (44) of a male connector (41), and substantially extends in a fitting direction of the male connector into a mating connector. The lock arm (53) locks the two connectors to each other in a fitted condition when a retaining projection (54), formed on the lock arm, is engaged in a retaining hole (58) formed in the female connector (42). A shutter (55) is formed at a distal end of the lock arm (53), and closes a terminal-fitting port (45*a*) in the male connector (41) when the retaining projection (54) is urged by a housing inner surface (64), and opens the terminal-fitting port (45*a*) when the retaining projection (54) is engaged in the retaining hole (58). A male terminal (62) is received in the female connector (42), and has a spring portion (62*b*) which can be compressively deformed along the terminal fitting direction.

8 Claims, 3 Drawing Sheets

200
45
54
53
55
58
62c
62b
66
62a
60
64
51
42
65
62
44
41
47
45a

HALF-FITTING PREVENTION CONNECTOR

BACKGROUND OF THE INVENTION

1. Field of the Invention

The present invention relates to a half-fitting prevention connector in which a half-fitted condition of two connectors is prevented.

The present application is based on Japanese Patent Application No. Hei. 11-169932, which is incorporated herein by reference.

2. Description of the Related Art

Usually, various electronic equipments are mounted on a vehicle such as an automobile, and therefore, naturally, various types of female and male connectors are provided at connection ends of various kinds of wires forming wire harnesses or the like.

Various half-fitting prevention connectors, capable of detecting a half-fitted condition of the female and male connectors, have been used, and such half-fitting prevention connectors are disclosed, for example, in Unexamined Japanese Utility Model Publication Nos. Hei. 5-53157 and Hei. 5-81967, and Unexamined Japanese Patent Publication No. Hei. 9-55261.

For example, a completely-fitting connector, disclosed in Unexamined Japanese Utility Model Publication No. Hei. 5-53157, comprises a plate, slidable in connector fitting and disengaging directions, and springs (torsion springs) urging this plate in the disengaging direction. During the fitting connection between the two connectors, the plate is abutted against an abutment portion of a lock lever of the mating connector, and if the fitting operation is stopped in this half-fitted condition, the connector and the mating connector are moved away from each other by the resilient force of the springs.

In a half-fitting prevention connector disclosed in Unexamined Japanese Utility Model Publication No. Hei. 5-81967, a movable cover for parallel movement in a fitting direction is mounted on an outer periphery of a second housing in a pair of connectors (to be fittingly connected together) through springs (compression springs) urging the movable cover in the fitting direction. With this construction, during a fitting operation, the movable cover normally urges a first housing in a disengaging direction.

In a connector disclosed in Unexamined Japanese Patent Publication No. Hei. 9-55261, return springs (zigzag springs) are mounted in one connector housing, and extend in a direction of insertion of the other connector housing. Elastic arms are formed integrally on the other connector housing so as to face the return springs, respectively. With this construction, during a fitting operation, the reaction force of the return springs produce a force tending to return the other connector housing.

Each of the above half-fitting prevention connectors comprises the pair of connector housings, and the spring members for producing the reaction force. During the fitting operation, the pushing force is produced by the reaction force of the spring members, and therefore if the connector fitting operation is finished in a half-fitted condition of the connectors, the two connectors in this half-fitted condition are disengaged from each other by the reaction force of the spring members, so that the two connectors are prevented from being kept in a half-fitted condition.

In the above half-fitting prevention connectors, however, even when the pair of connectors are incompletely fitted together, pin contacts in one of the two connector housings are fitted respectively in socket contacts in the other connector housing.

Therefore, the spring members, which serve to disengage the two connectors from each other in a half-fitted condition of the connectors, need to produce the sufficient reaction force to disengage the pin contacts from the socket contacts, and therefore there has been encountered a problem that a large operating force is required for the connector fitting operation.

And besides, each of the above half-fitting prevention connectors requires the spring members, and a movable member, such as a slider, for canceling the reaction force of the spring members, and therefore the number of the component parts increases, and also the number of assembling steps increases. This has invited a problem in that the production cost increases.

SUMMARY OF THE INVENTION

It is therefore an object of the present invention to overcome the above problems, and more specifically to provide an improved half-fitting prevention connector in which an operating force, required for fitting two connectors together, is reduced, thereby enhancing the efficiency of the fitting operation, and besides the number of component parts is reduced, thereby reducing the production cost.

To achieve the above object, according to the first aspect of the present invention, there is provided a half-fitting prevention connector which comprises a first connector housing including a terminal-fitting port formed therein, a first connection terminal receivable in the first connector housing, a second connector housing fittable to the first connector housing, the second connector housing including an engagement portion, a second connection terminal receivable in the second connector housing, and fittable to the first connection terminal, the second connection terminal including a spring portion which can be compressively deformed along a terminal fitting direction, a lock arm formed on the first connector housing, and substantially extending in a fitting direction of the first and second connector housings, the lock arm including a retaining projection, the lock arm retaining the first and second connector housings in a fitted condition when the retaining projection is engaged with the engagement portion of the second connector housing, and a screen plate formed on a distal end of the lock arm, the screen plate closing the terminal-fitting port of the first connector housing when the retaining projection is urged by the second connector housing, and opening the terminal-fitting port to allow the first connection terminal to fit to the second connection terminal through the terminal-fitting port when the retaining projection is engaged with the engagement portion.

According to the second aspect of the present invention, the spring portion may be formed integrally with the second connection terminal.

According to the third aspect of the present invention, the second connection terminal includes a contact portion for connecting with the first connection terminal, and a wire clamping portion for clamping a wire, and wherein the spring portion may be formed between the contact portion and the wire clamping portion.

According to the fourth aspect of the present invention, the lock arm may be formed in a cantilever-like manner on an outer surface of the first connector housing to extend obliquely upwardly from the outer surface of the first connector housing in a natural condition in which no external force acts on the lock arm, so that the screen plate opens the terminal-fitting port of the first connector housing.

According to the fifth aspect of the present invention, when the first and second connector housings are in a half-fitted condition, the retaining projection of the lock arm abuts against an inner surface of the second connector housing so that the lock arm is downwardly urged toward the outer surface of the first connector housing thereby closing the terminal-fitting port with the screen plate, and the second connection terminal is abutted against the screen plate, and when the first and second connector housings are in a completely-fitted condition, the retaining projection is engaged with the engagement portion formed in the inner surface of the second connector housing so that the screen plate opens the terminal-fitting port to allow the first connection terminal to fit to the second connection terminal through the terminal-fitting port.

According to the sixth aspect of the present invention, when the first and second connector housings are in a half-fitted condition, the spring portion of the second connection terminal is compressively deformed along the terminal fitting direction, and the first and second connector housings are pushed back away from each other by a resilient force of the spring portion.

In the above construction, during the connector fitting operation, the retaining projection of the lock arm is not engaged with the engagement portion of the second connector housing, but is urged by an inner surface of the second connector housing, and therefore the terminal-fitting port of the first connector housing is closed by the screen plate formed on the distal end of the lock arm.

Therefore, even when the connector-fitting operation thus proceeds, the second connection terminal received in the second connector housing can not enter the terminal-fitting port of the first connector housing, so that the spring portion is compressively deformed along the terminal fitting direction, with its distal end held against the screen plate. Therefore, the second connection terminal received in the second connector housing is not fittingly connected to the first connection terminal received in the first connector housing.

Therefore, even if the fitting operation is stopped in this condition, the two connector housings are disengaged from each other by a resilient force of the spring portion, so that the two connector housings are prevented from being kept in the half-fitted condition.

At the time of disengaging the two connector housings in the half-fitted condition from each other, the first connection terminal in the first connector housing is not yet fittingly connected to the second connection terminal in the second connector housing, and therefore the resilient force, produced by the spring portion of the second connection terminal, needs only to have a magnitude necessary for merely disengaging the housings from each other.

Therefore, as compared with the conventional half-fitting prevention connector in which the fitting engagement between the male and female terminals must also be canceled, the resilient force of the spring portion can be made smaller, so that the operating force, required for fitting the two connector housings together, can be reduced, thereby enhancing the efficiency of the fitting operation.

And besides, the spring portion, serving to disengage the two connector housings from each other, is formed integrally with the second connection terminal which is to be received in the second connector, and therefore separate spring members and a movable member do not need to be provided as the conventional half-fitting prevention connector, and the production cost can be reduced because of a reduced number of the component parts.

When the two connector housings are completely fitted together, the retaining projection is fitted in the engagement portion, and hence ceases to be urged by the housing inner surface, so that the screen plate, which has so far closed the terminal-fitting port in the connector fitting operation, opens the terminal-fitting port.

As a result, the second connection terminal received in the second connector housing projects into the terminal-fitting port, so that the second connection terminal in the second connector housing is fittingly connected to the first connection terminal in the first connector.

DETAILED DESCRIPTION OF THE PREFERRED EMBODIMENTS

Figure 1:
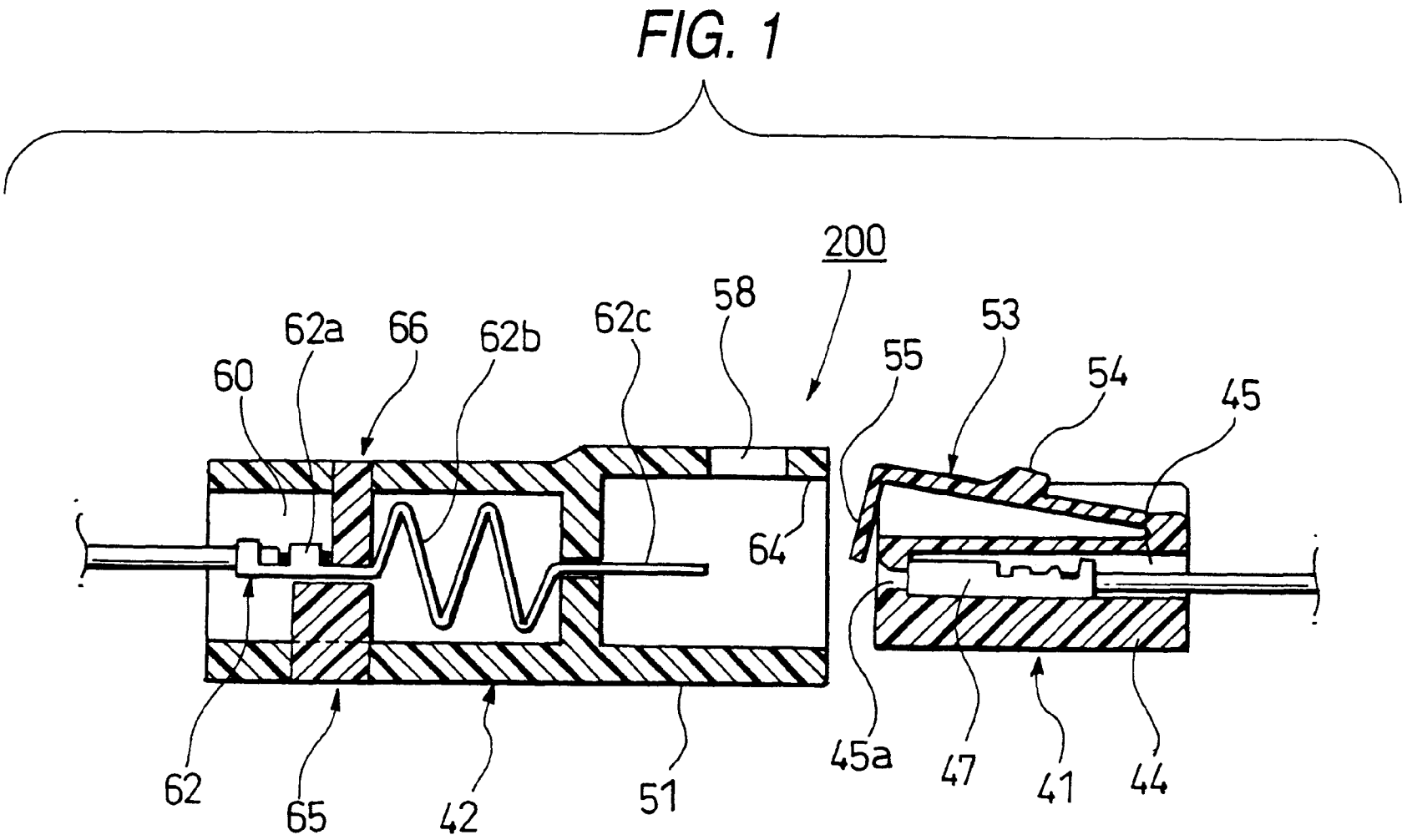
FIG. 1 is an exploded, vertical cross-sectional view roughly showing one preferred embodiment of a half-fitting prevention connector of the present invention.

Preferred embodiments of a half-fitting prevention connector of the present invention will now be described in detail with reference to FIGS. 1 to 5.

A half-fitting prevention connector 200 of this embodiment comprises a pair of male and female connectors 41 and 42 to be fitted together in a male-female manner.

A row of juxtaposed terminal receiving chambers 45 are formed in a housing 44 of the male connector (first connector) 41, and extend therethrough in a direction of fitting of the two connectors, and female terminals (connection terminals in the first connector) 47 are received and held respectively in the terminal receiving chambers 45. Each of the female terminals 47 is retained in the associated terminal receiving chamber 45 against withdrawal by a retaining lance (not shown) or the like.

A lock arm 53 is formed (molded) integrally on an outer surface (upper surface in FIG. 1) of the housing 44, and extends in the direction of fitting of the male connector into the female connector (second connector) 42. The lock arm 53 is an elastic arm of the cantilever type extending from a rear end portion of the housing 44 toward a front end thereof. A retaining projection 54, formed on an upper surface of this lock arm, is engaged in a retaining hole 58 in the female connector 42 (described later), thereby locking the two connectors to each other in a fitted condition.

A shutter 55 in the form of a screen plate is formed integrally at a distal end of the lock arm 53. When the lock arm 53 is in a natural condition in which no external force acts on the lock arm, the lock arm 53 extends obliquely upwardly in such a manner that the shutter 55, extending downwardly from the distal end of the lock arm 53, opens terminal-fitting ports 45*a* formed in the front end of the housing 44, as shown in FIG. 1.

When the lock arm 53 is urged or pressed toward the terminal receiving chambers 45 to be disposed generally parallel to the upper surface of the housing 44, the shutter 55 closes the terminal-fitting ports 45*a* in the front end of the housing 44.

Although the shutter 55 is formed (molded) integrally at the distal end of the lock arm 53, the shutter may be molded into a separate member, in which case this separate member is connected to the lock arm to provide a unitary construction.

Another alternative is to provide an integrally-molded structure in which the proximal end portion of the lock arm 53 is formed into a thin hinge portion, and the lock arm 53 extends perpendicularly from the upper surface of the housing 44, and in use, the lock arm 53 thus molded is tilted toward the front end portion of the housing 44.

Terminal receiving chambers 60 are formed longitudinally through a housing 51 of the female connector 42, and are arranged in a row corresponding to that of the terminal receiving chambers 45 in the male connector 41. Male terminals (connection terminals in the second connector) 62 are received and held respectively in the terminal receiving chambers 60. The retaining hole (engagement portion) 58 is formed in a connector fitting portion of the housing 51 defined by a front portion thereof, and when the male connector 41 is completely fitted in the female connector 42, the retaining projection 54 is fitted in the retaining hole 58, thereby locking the two connectors to each other in this completely-fitted condition. This engagement portion is not limited to the retaining hole, but may be a step portion or the like recessed in the inner surface of the connector fitting portion.

The male terminal 62 of an integral construction includes a wire clamping portion 62*a* for clamping connection to an end portion of a wire, a spring portion 62*b* formed into a wavy shape, and a tongue-like portion 62*c* for fitting into the female terminal 47.

The spring portion 62*b* can be compressively deformed along the terminal fitting direction. The male terminal 62 is fixed to the housing 51 at that portion thereof disposed adjacent to the wire clamping portion 62*a*, and the wavy spring portion 62*b* is resiliently deformed in the direction of compression thereof in accordance with the amount of a pressing force applied to the tongue-like portion 62*c* defining the distal end portion of the male terminal.

Each male terminal 62 is inserted into the associated terminal receiving chamber 60, and thereafter terminal holders 66 and 65 are inserted into the housing 51 respectively from the upper and lower sides thereof to hold each male terminal 62 therebetween to thereby retain the same in a predetermined position in the terminal receiving chamber 60.

Figure 2:
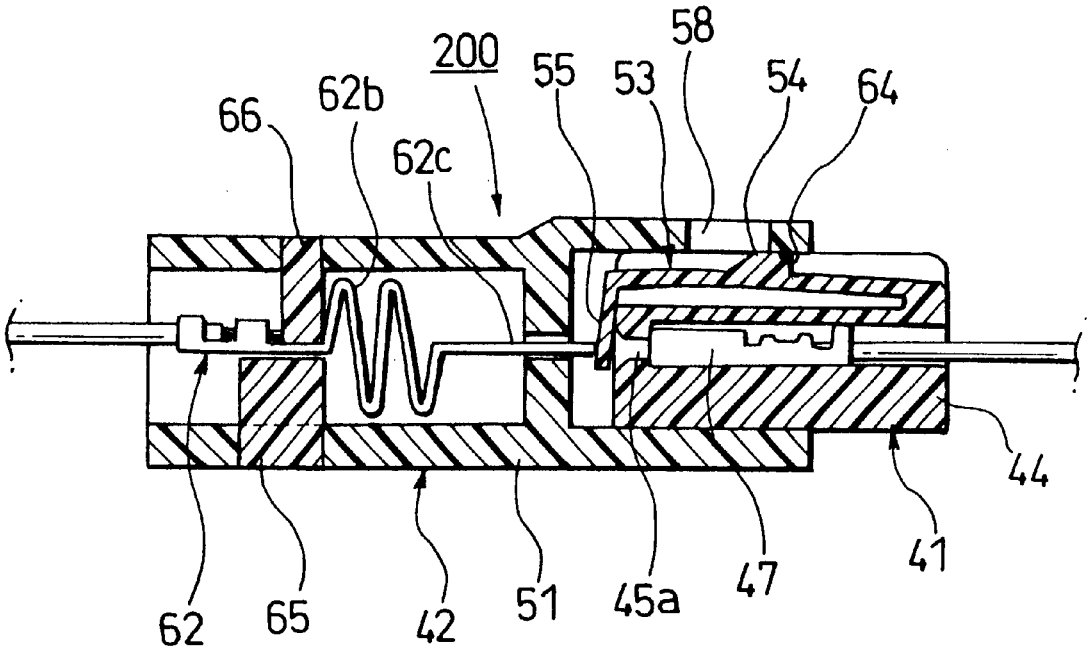
FIG. 2 is a vertical cross-sectional view of the half-fitting prevention connector of FIG. 1 in a half-fitted condition.

When the operation for fitting the male and female connectors 41 and 42 together is started as shown in FIG. 2, the retaining projection 54, formed on the lock arm 53 of the male connector 41, abuts against an inner surface 64 of the housing 51, lying between the retaining hole 58 in the housing 51 and the front end of the housing 51, so that the lock arm 53 is urged or pressed toward the terminal receiving chambers 45 to be disposed generally parallel to the upper surface of the housing 44.

Thus, the male connector 41 is inserted into the connector fitting portion of the male connector 42, with the shutter 55 closing the terminal-fitting ports 45*a* formed in the front end of the housing 44.

Therefore, even when the connector-fitting operation thus proceeds, each of the male terminals 62, received in the female connector 42, can not enter the associated terminal-fitting port 45*a* in the housing 44, so that the spring portion 62*b* is compressively deformed along the terminal fitting direction, with the tongue-like portion 62*c* held against the shutter 55. Therefore, the male terminals 62, received in the female connector 42, are not fitted respectively into the female terminals 47 received in the male connector 41.

Therefore, even if the fitting operation of the half-fitting prevention connector 200 is stopped in this condition, the male and female connectors 41 and 42 are pushed back in their respective disengaging directions (opposite to their respective fitting directions) away from each other by the resilient force of the spring portions 62*b*, so that this half-fitted condition can be easily detected, and therefore the two connectors are prevented from being kept in the half-fitted condition.

At the time of disengaging the male and female connectors 41 and 42 in the half-fitted condition from each other, the male terminals 62 in the female connector 42 are not yet fitted respectively in the female terminals 47 in the male connector 41, and therefore the resilient force, produced by the spring portions 62*b* of the male terminals 62, need only to have a magnitude necessary for merely disengaging the housings 41 and 51 of the male and female connectors 41 and 42 from each other.

Therefore, as compared with the conventional half-fitting prevention connector in which the fitting engagement between the male and female terminals must also be canceled, the resilient force of the spring portions 62*b* can be made smaller, so that the operating force, required for fitting the two connectors together, can be reduced, thereby enhancing the efficiency of the fitting operation.

And besides, the spring portion 62*b*, serving to disengage the two connectors from each other, is formed integrally with the male terminal 62 which is to be received in the female connector 42, and therefore separate spring members and a movable member, such as a slider, do not need to be provided, and the production cost can be reduced because of a reduced number of the component parts.

Figure 3:
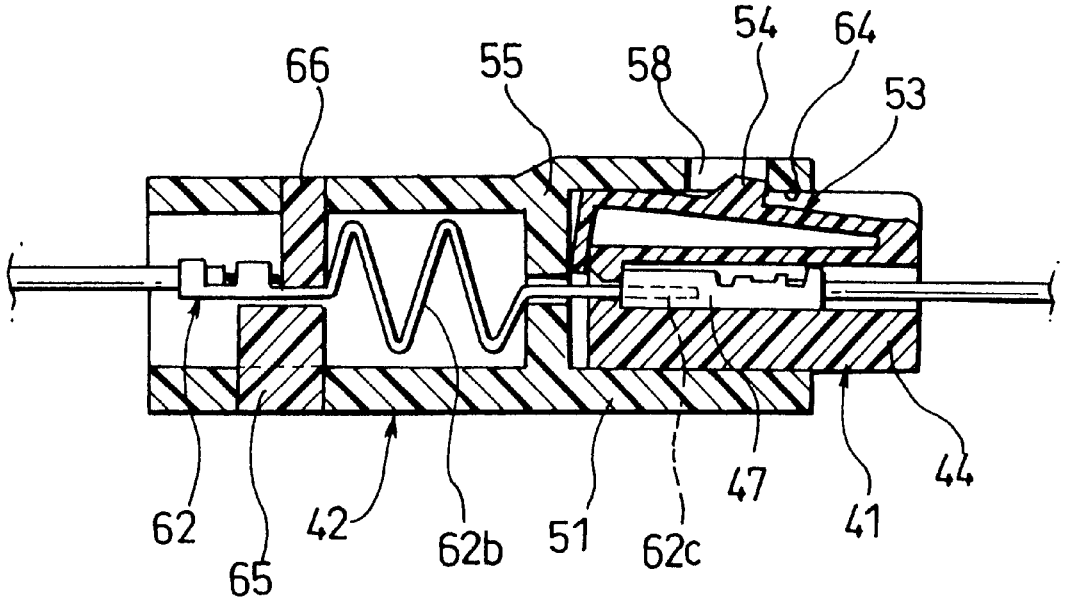
FIG. 3 is a vertical cross-sectional view of the half-fitting prevention connector of FIG. 1 in a completely-fitted condition.

When the male and female connectors 41 and 42 are completely fitted together as shown in FIG. 3, the retaining projection 54 is fitted in the retaining hole 58, and hence ceases to be urged by the housing inner surface 64, and the lock arm 53 is resiliently restored upwardly, so that the shutter 55, which has so far closed the terminal-fitting ports 45*a* in the connector fitting operation, opens these ports 45*a*.

As soon as the terminal-fitting ports 45*a* are thus opened, the tongue-like portion 62*c* of each of the male terminals 62, received in the female connector 42, projects through the associated terminal-fitting port 45*a*, so that the male terminals 62 in the female connector 42 are fitted respectively into the female terminals 47 in the male connector 41.

In the half-fitting prevention connector of the present invention, the housings, the lock arm, the screen plate, the springs and so on are not limited to their respective structures in the half-fitting prevention connector 200 of this embodiment, but can be modified in various ways without departing from the scope of the present invention.

Figure 4A:
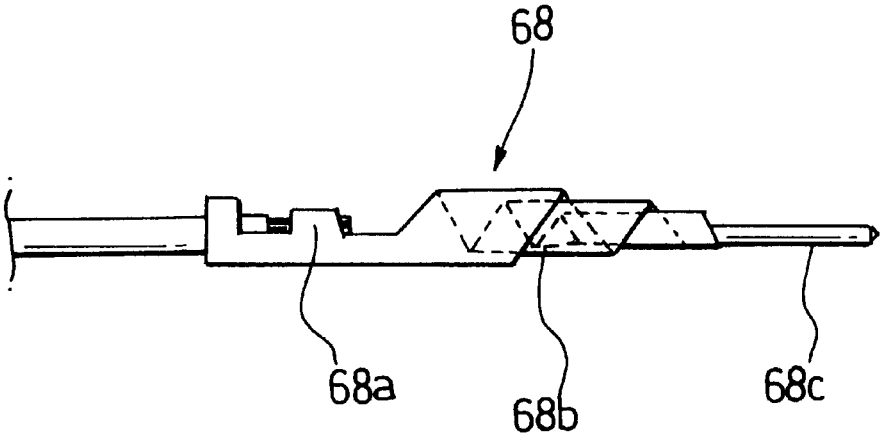
FIG. 4A is a side-elevational view of a modification of a male terminal shown in FIG. 1.
Figure 4B:
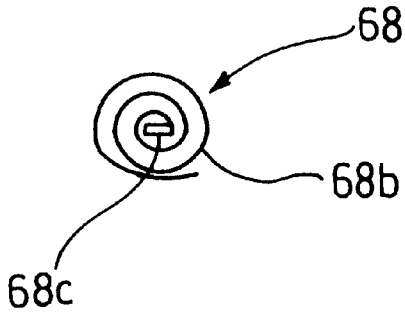
FIG. 4B is a front-elevational view of the male terminal of FIG. 4A.

For example, a male terminal 68, shown in FIGS. 4A and 4B, is a connection terminal to be received in the second connector, and this male terminal of an integral construction includes a wire clamping portion 68*a* for clamping connection to the end portion of the wire, a spring portion 68*b*, and a tongue-like portion 68*c* for fitting into the female terminal 47.

The spring portion 68*b* is in the form of a volute spring (a conical coil spring having a rectangular cross-section) which can be compressively deformed along the terminal fitting direction. The spring portion 68*b* is resiliently deformed in the direction of compression thereof in accordance with the amount of a pressing force applied to the tongue-like portion 68*c* defining the distal end portion of the male terminal.

Figure 5:
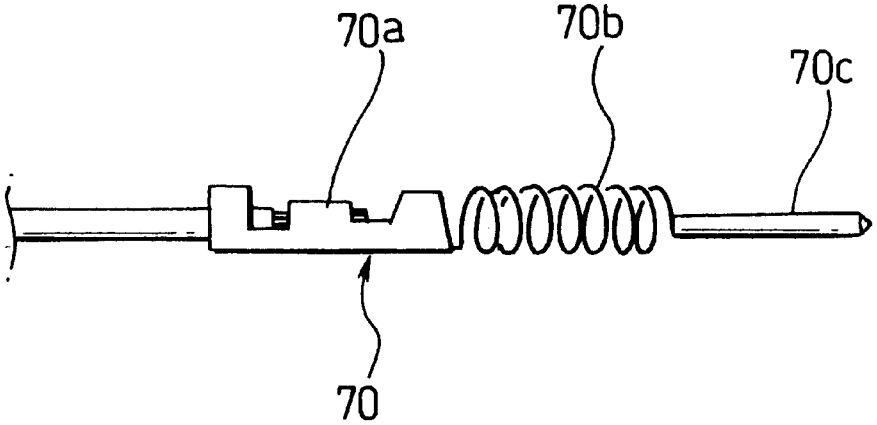
FIG. 5 is a side-elevational view of another modification of the male terminal shown in FIG. 1.

A male terminal 70, shown in FIG. 5, is a connection terminal to be received in the second connector, and this male terminal of an integral construction includes a wire clamping portion 70*a* for clamping connection to the end portion of the wire, a spring portion 70*b*, and a tongue-like portion 70*c* for fitting into the female terminal 47.

The spring portion 70*b* is in the form of a compression coil spring which can be compressively deformed along the terminal fitting direction. The spring portion 70*b* is resiliently deformed in the direction of compression thereof in accordance with the amount of a pressing force applied to the tongue-like portion 70*c* defining the distal end portion of the male terminal.

In so far as the spring portions of the connection terminals, received in the second connector, can provide the resilient force necessary for disengaging the two housings from each other in a half-fitted condition of the two connectors, and can also provide the predetermined resilient force necessary for connecting these connection terminals to the respective mating terminals, the spring portions, which can be compressively deformed along the terminal fitting direction, can have any suitable structure, and are not limited to the structure in the above embodiment, and can take any suitable form.

In the half-fitting prevention connector, during the connector fitting operation, the terminal-fitting ports in the first connector are closed by the screen plate formed at the distal end of the lock arm. Therefore, each of the connection terminals, received in the second connector, can not enter the associated terminal-fitting port in the first connector, so that the spring portion is compressively deformed along the terminal fitting direction, with its distal end held against the screen plate. Therefore, the connection terminals, received in the second connector, are not fitted respectively into the connection terminals received in the first connector.

Therefore, even if the fitting operation is stopped in this condition, the two connectors are disengaged from each other by the resilient force of the spring portions, so that the two connectors are prevented from being kept in a half-fitted condition. At this time, the connection terminals in the first connector are not yet fittingly connected respectively to the connection terminals in the second connector, and therefore the resilient force, produced by the spring portions of the connection terminals, need only to have a magnitude necessary for merely disengaging the housings of the two connectors from each other.

Therefore, the resilient force of the spring portions can be made smaller, so that the operating force, required for fitting the two connectors together, can be reduced, thereby enhancing the efficiency of the fitting operation. And besides, the spring portion, serving to disengage the two connectors from each other, is formed integrally with the connection terminal which is to be received in the second connector, and therefore the production cost can be reduced because of a reduced number of the component parts.

What is claimed is:

1. A half-fitting prevention connector, comprising:

a first connector housing including a terminal-fitting port formed therein;

a first connection terminal receivable in the first connector housing;

a second connector housing fittable to the first connector housing, the second connector housing including an engagement portion;

a second connection terminal receivable in the second connector housing, and fittable to the first connection terminal, the second connection terminal including a spring portion which can be compressively deformed along a terminal fitting direction;

a lock arm formed on the first connector housing, and substantially extending in a fitting direction of the first and second connector housings, the lock arm including a retaining projection, the lock arm retaining the first and second connector housings in a fitted condition when the retaining projection is engaged with the engagement portion of the second connector housing; and a screen plate formed on a distal end of the lock arm, the screen plate closing the terminal-fitting port of the first connector housing when the retaining projection is urged by the second connector housing, and opening the terminal-fitting port to allow the first connection terminal to fit to the second connection terminal through the terminal-fitting port when the retaining projection is engaged with the engagement portion.

2. A half-fitting prevention connector according to claim 1, wherein the spring portion is formed integrally with the second connection terminal.

3. A half-fitting prevention connector according to claim 1, wherein the second connection terminal includes a contact portion for connecting with the first connection terminal, and a wire clamping portion for clamping a wire, and wherein the spring portion is formed between the contact portion and the wire clamping portion.

4. A half-fitting prevention connector according to claim 1, wherein the lock arm is formed in a cantilever-like manner on an outer surface of the first connector housing to extend obliquely upwardly from the outer surface of the first connector housing in a natural condition in which no external force acts on the lock arm, so that the screen plate opens the terminal-fitting port of the first connector housing.

5. A half-fitting prevention connector according to claim 4, wherein, when the first and second connector housings are in a half-fitted condition, the retaining projection of the lock arm abuts against an inner surface of the second connector housing so that the lock arm is downwardly urged toward the outer surface of the first connector housing thereby closing the terminal-fitting port with the screen plate, and the second connection terminal is abutted against the screen plate, and when the first and second connector housings are in a completely-fitted condition, the retaining projection is engaged with the engagement portion formed in the inner surface of the second connector housing so that the screen plate opens the terminal-fitting port to allow the first connection terminal to fit to the second connection terminal through the terminal-fitting port.

6. A half-fitting prevention connector according to claim 5, wherein when the first and second connector housings are in a half-fitted condition, the spring portion of the second connection terminal is compressively deformed along the terminal fitting direction, and the first and second connector housings are pushed back away from each other by a resilient force of the spring portion.

7. A half-fitting prevention connector according to claim 1, wherein, when the first and second connector housings are in a half-fitted condition, the retaining projection of the lock arm abuts against an inner surface of the second connector housing so that the screen plate closes the terminal-fitting port, and the second connection terminal is abutted against the screen plate, and when the first and second connector housings are in a completely-fitted condition, the retaining projection is engaged with the engagement portion formed in the inner surface of the second connector housing so that the screen plate opens the terminal-fitting port to allow the first connection terminal to fit to the second connection terminal through the terminal-fitting port.

8. A half-fitting prevention connector according to claim 7, wherein when the first and second connector housings are in a half-fitted condition, the spring portion of the second connection terminal is compressively deformed along the terminal fitting direction, and the first and second connector housings are pushed back away from each other by a resilient force of the spring portion.

* * * * *